US005497885A

United States Patent [19]

Sussman

[11] Patent Number: 5,497,885

[45] Date of Patent: Mar. 12, 1996

[54] LAP TRAY FOR CARRYING FOOD

[76] Inventor: Sy Sussman, 435 Promontory Dr. West, Newport Beach, Calif. 92661

[21] Appl. No.: 341,413

[22] Filed: Nov. 17, 1994

[51] Int. Cl.[6] ..... B65D 1/34

[52] U.S. Cl. ..... 206/563; 206/217; 220/575; 220/555

[58] Field of Search ..... 206/217, 563, 206/564; 220/17.1, 17.2, 17.3, 553, 555, 574, 575

[56] References Cited

U.S. PATENT DOCUMENTS

| | | | |
|---|---|---|---|
| 1,595,356 | 8/1926 | Moseman | 220/575 |
| 2,240,020 | 4/1941 | Raiser | 220/555 |
| 2,561,022 | 7/1951 | Jones | 220/575 |
| 2,808,191 | 10/1957 | Cramer | 206/217 |
| 3,436,008 | 4/1969 | Santangelo | 220/555 |
| 4,279,354 | 7/1981 | Conti | 220/555 |
| 4,823,958 | 4/1989 | Mahmud | 206/217 |
| 5,111,960 | 5/1992 | Zilliox | 220/575 |
| 5,184,750 | 2/1993 | Moller | 220/575 |
| 5,207,743 | 5/1993 | Costarella et al. | 220/575 |
| 5,249,700 | 10/1993 | Dumke | 220/574 |
| 5,346,070 | 9/1994 | McSpadden | 220/575 |
| 5,441,164 | 8/1995 | Beck et al. | 220/575 |

*Primary Examiner*—David T. Fidei
*Attorney, Agent, or Firm*—Hawes & Fischer

[57] ABSTRACT

A lap tray is disclosed for carrying food such as that available from a take-out or fast food restaurant. The lap tray has particular application for use by an individual wishing to consume the food carried on the tray while riding as a passenger in a motor vehicle that is subjected to the usual road turbulence. The lap tray includes a pair of food serving compartments, each of which is surrounded by a raised lip to prevent food carried thereon from falling off the tray. A raised annular rim surrounds a hole formed through the tray in which a drinking cup is received so as to retain the cup in an upright configuration and thereby prevent the cup from tipping and spilling its contents. A pair of legs depends from the tray at opposite sides thereof to extend downwardly along the legs of the user so as to stabilize the tray against lateral displacement when the user is seated and the tray is laid across the user's lap.

8 Claims, 3 Drawing Sheets

LAP TRAY FOR CARRYING FOOD

BACKGROUND OF THE INVENTION

1. Field of the Invention

This invention relates to a low cost, disposable, lap tray on which different food items and a drinking cup filled with a beverage (e.g. such as those available from a takeout or fast food restaurant) can be safely and conveniently carried while the user is riding as a passenger in a moving vehicle.

2. Background Art

It is common for adults and children to stop off at a takeout or fast food restaurant when traveling in a vehicle away from home to purchase various food items such as, but not limited to, a hamburger, hot dog, tacos, pizza, fried potatoes, chips and a drinking cup that has been filled with a beverage. The consumer might wish to carry his purchase away from the restaurant on a flat tray or in a box. If the consumer is riding as a passenger in a moving vehicle, he might wish to place the box or tray on his lap and, while in transit, eat the food items and drink the beverage from the cup. In this case, the consumer must keep at least one hand on the box or tray during most times to prevent such box or tray from sliding about and possibly falling off his lap.

More particularly, when the ride is characterized by bumps, turns, and sudden stops or starts, the vehicle is often subjected to different mechanical forces. Such forces are transmitted from the vehicle to the box or tray on which the food and drinking cup are carried. The food and cup may be displaced in response to the forces to which the box or tray is subjected. In this regard, the food may roll or slide off the tray and/or the cup may tip over. Consequently, the food may fall on the floor and become inedible. Moreover, the beverage may be spilled. If the beverage is hot, the consumer could suffer injury. In any event, the food and beverage may be wasted and some or all of the meal lost.

SUMMARY OF THE INVENTION

A lap tray is disclosed which overcomes the aforementioned problems that are inherent with the usual boxes and trays on which takeout or fast food is carried by a consumer riding as a passenger in a moving vehicle. The lap tray of the present invention includes a pair of flat base members that are arranged side-by-side one another and surrounded by a first raised lip that functions as a barrier to prevent food items carried on the base members from sliding off the tray. A second raised lip extends across the middle of the tray between the flat base members to form two separate compartments in which different food items may be carried. A hole is formed through the rear of the tray midway between the opposing sides thereof. The hole is surrounded by an annular support rim and dimensioned to receive a conventional drinking cup therewithin so that the cup will be retained upright to avoid spilling the liquid contents.

A pair of legs depend downwardly from the base members in spaced parallel alignment with one another at opposite sides of the tray. When the base is laid flat on the lap of the user, the legs of the tray extend downwardly along the legs of the user to prevent lateral displacement of the tray and thereby free both of the user's hands for lifting the food and the drinking cup off the tray. The legs of the tray located against the legs of the user also stabilize the tray in response to road induced turbulence to prevent the food from sliding around the base members as the vehicle is in motion.

DETAILED DESCRIPTION

Figure 1:
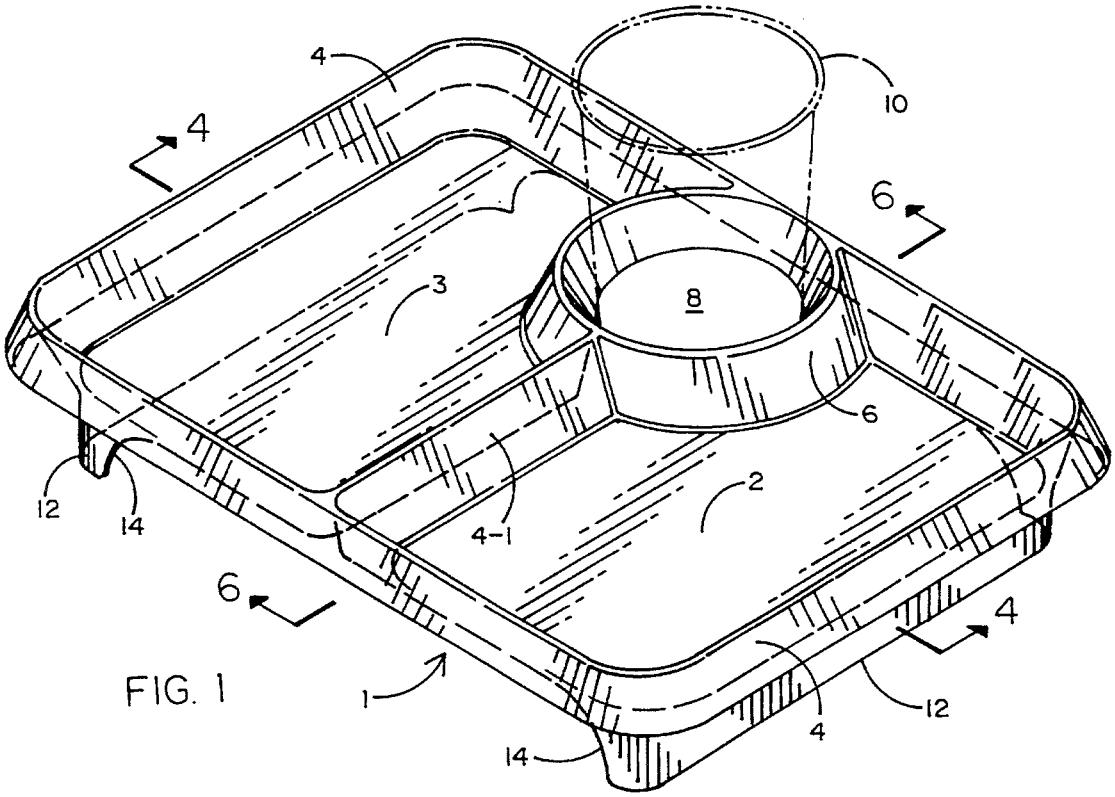
FIG. 1 is a perspective view of the lap tray for carrying food which forms the present invention.
Figure 2:
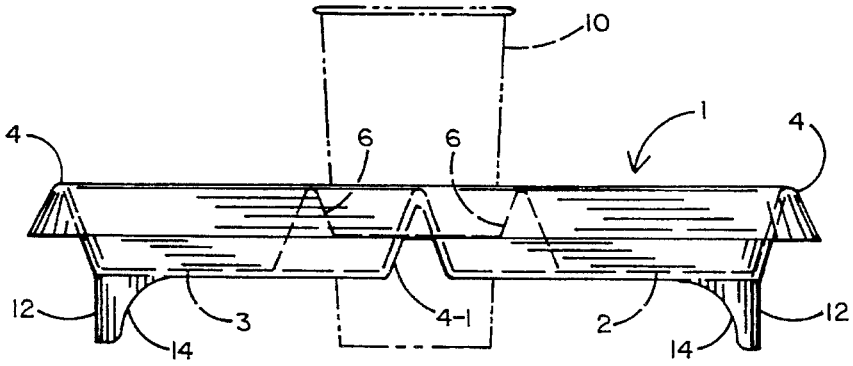
FIG. 2 is a front elevation of the lap tray of FIG. 1.
Figure 3:
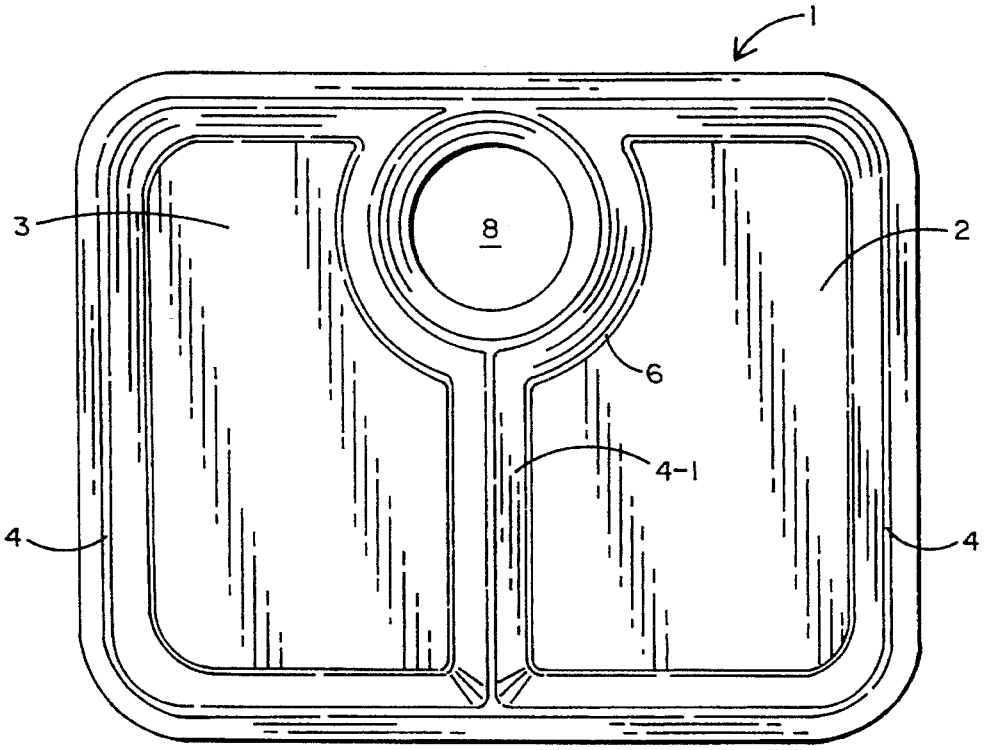
FIG. 3 is a top plan view of the lap tray of FIG. 1.

The lap tray 1 for carrying food which forms the present invention is initially described while referring concurrently to FIGS. 1–6 of the drawings. As will be described in greater detail when referring hereinafter to FIG. 7, the lap tray 1 is adapted to be laid upon the lap of a user when the user is in a seated position. In this regard, the lap tray 1 may be positioned across the legs of the user while riding as a passenger in a moving vehicle to better stabilize the tray in response to the usual physical forces that are typically encountered by one who rides in a car, truck, bus, etc., over bumpy and winding roads.

The lap tray 1 is preferably manufactured (e.g. molded or pressed) from a low cost, impact resistant material such as reprocessed (i.e. molded fiber) paper, plastic, or the like.

The tray 1 is provided with a pair of flat base members 2 and 3 located side-by-side one another. A first raised lip 4 having an inverted V-shape projects upwardly from and extends around the outer periphery of the base members 2 and 3 so as to provide a barrier and thereby prevent any food carried on the base members from sliding off the tray 1. In addition, a second raised lip 4-1 extends in a direction across the middle of the tray 1 between base members 2 and 3 so as to define two separate serving compartments in which to carry different food products, such as those commonly sold at or available from takeout or fast food restaurants.

Projecting upwardly from the rear of the tray 1 is an annular cup support rim 6. The cup support rim 6 surrounds a hole 8 formed through the tray 1 midway between the opposing sides thereof. The hole 8 has a diameter which is dimensioned to receive therethrough a drinking cup (shown in phantom lines in FIGS. 1 and 2 and designated by the reference numeral 10) which is commonly available at takeout and fast food restaurants and in which a hot or cold beverage (e.g. coffee, soft drinks or water) is usually served. When the drinking cup 10 is located in the hole 8 through tray 1, a relatively tight friction fit is established between the cup and the support rim 6. Thus, the cup 10 will be reliably retained by support rim 6 against sliding movement and maintained in an upright condition within the hole 8 so as to minimize the likelihood that the cup will tip over and the beverage within the cup 10 spilled when the tray 1 is carried from one place to another and/or subjected to road turbulence.

Figure 4:
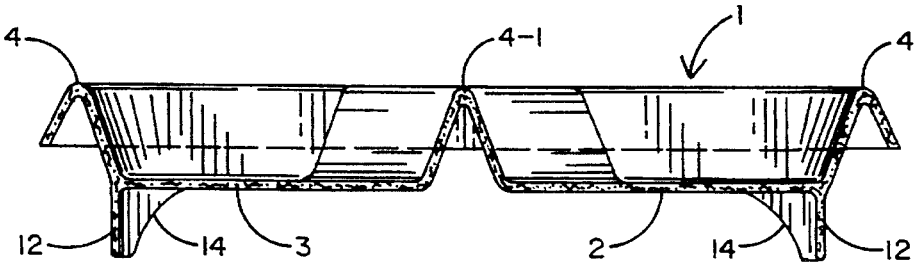
FIG. 4 is a cross-section of the lap tray taken along lines 4—4 of FIG. 1.
Figure 5:
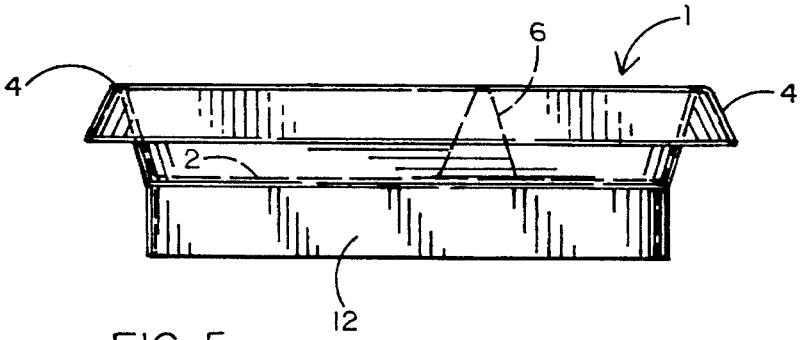
FIG. 5 is a side elevation of the lap tray of FIG. 1.
Figure 6:
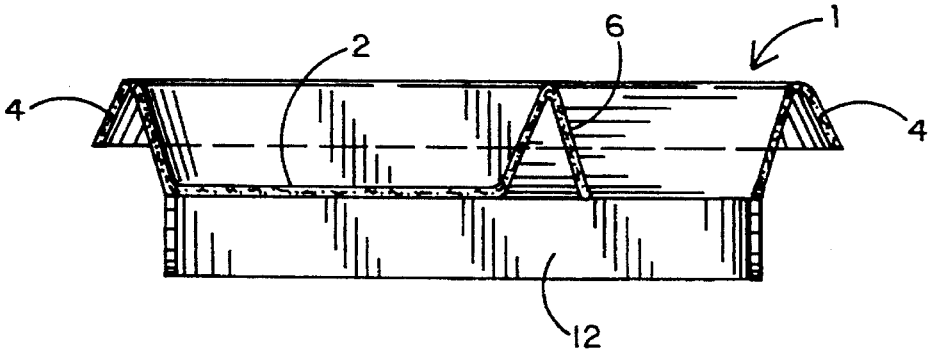
FIG. 6 is a cross-section of the lap tray taken along lines 6—6 of FIG. 1.

As is best shown in FIGS. 1 and 4 of the drawings, the second raised lip 4-1 and the annular cup support rim 6 are coextensively joined to one another. With the hole 8 for receiving a drinking cup 10 located at the rear of lap tray 1, the cup 10 will be carried in an out of the way location on the lap tray 1 while permitting the user relatively easy and unobstructed access from the front of the tray and to the food carried in the adjacent serving compartments atop the base members 2 and 3.

Depending downwardly from the base members 2 and 3 of lap tray 1 is a pair of legs 12. The legs 12 are spaced from one another and disposed in parallel alignment at opposite sides of the tray. Each leg 12 includes an inwardly facing surface 14 (best shown in FIG. 4) having an arcuate shape to facilitate resting the tray 1 upon the lap of the user (best shown in FIG. 7).

Figure 7:
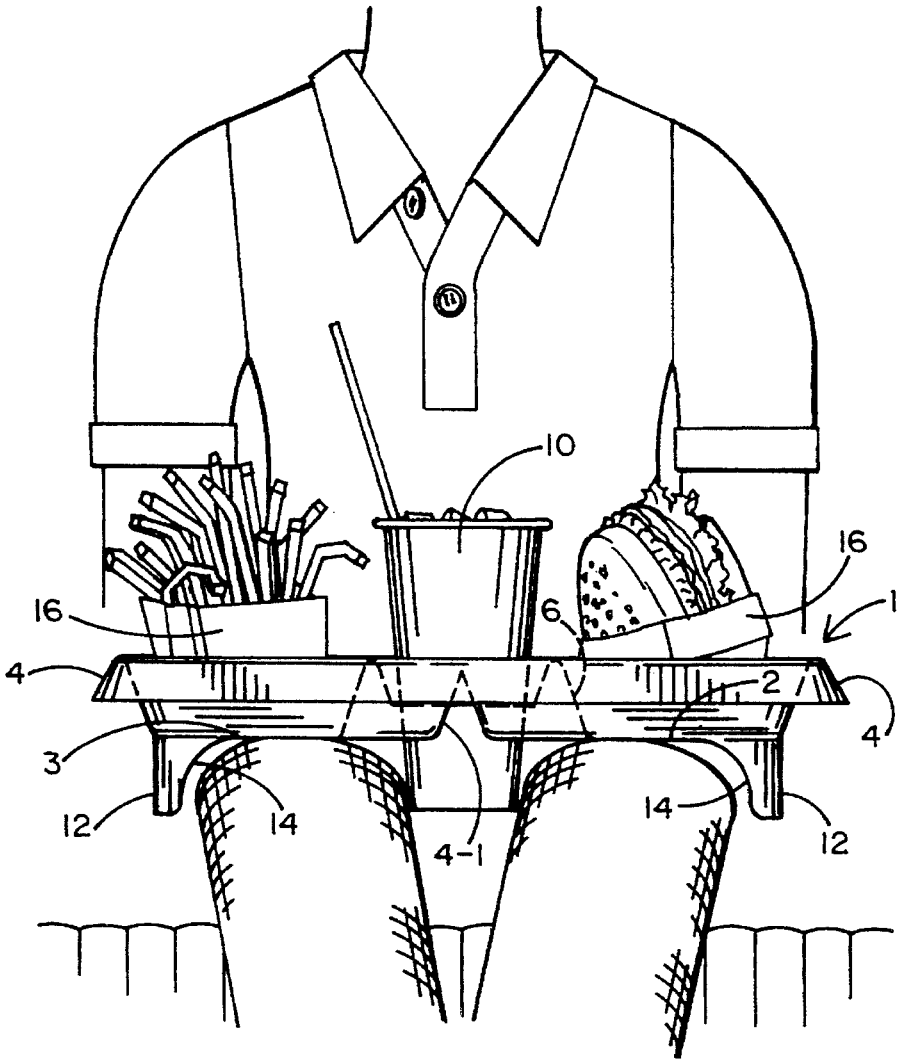
FIG. 7 shows the lap tray resting upon the lap of a user who assumes a seated position.

To this end, and referring now to FIG. 7 of the drawings, the lap tray 1 is shown with the flat base members 2 and 3 seated across the legs of the user, such as when the user is a passenger riding in a moving motor vehicle. The legs 12 of tray 1 which depend from the base members 2 and 3 extend downwardly along the outer sides of the user's legs to help prevent a lateral displacement of the tray and a corresponding movement of the food 16 carried thereon in response to road induced turbulence. Moreover, a cup 10 received by cup support rim 6 may be of sufficient length to project downwardly from the lap tray 1 to be disposed between the user's legs and cooperate with the legs 12 to help stabilize the tray. Accordingly, the user need not use his hands to constantly steady the tray on this lap, but will advantageously have both hands free for lifting the food 16 and drinking cup 10 off the tray 1 for consumption. Once the meal is finished or the trip completed, the lap tray 1 is easily removed from the user's lap to be either discarded or stored away for reuse.

It will be apparent that while a preferred embodiment of the invention has been shown and described, various modifications and changes may be made without departing from the true spirit and scope of the invention. For example, while the lap tray 1 has been described as having particular application for use by an individual transporting food while riding as a passenger in a moving vehicle, it is to be understood that the lap tray 1 herein described may also be conveniently used with the user at rest while viewing a sporting event or at home while seated on a reclining chair and watching television. What is more, the lap tray 1 need not rest on the lap of a user, but may also be placed on any flat surface, such as a table or the ground.

Having thus set forth the preferred embodiment, what is claimed is:

1. A tray for carrying food, said tray having a back, a front, opposite sides, and comprising a flat base on which the food is to be placed, a first raised lip projecting from and extending around the periphery of said base to form a barrier to prevent the food that is placed on said base from sliding off said tray, a hole formed through said base and dimensioned to receive a drinking cup therein, and a pair of legs arranged in parallel alignment with one another and depending downwardly from said base at opposite sides of said tray, said legs projecting below said base by a distance sufficient to rest upon a flat surface and to extend below the lap and along the legs of a user to support said tray against lateral sliding displacement when the user is seated and said flat base is laid upon the user's lap.

2. The tray for carrying food recited in claim 1, further comprising a second raised lip projecting from and extending in a direction across said flat base between the front and back of said tray to establish a pair of adjacent food compartments separated by said second raised lip.

3. The tray for carrying food recited in claim 1, further comprising an annular rim projecting from said flat base and surrounding said hole through said base to support the drinking cup received in said hole in an upright position.

4. The tray for carrying food recited in claim 1, wherein the hole through said flat base is located at the rear of said tray midway between the opposite sides thereof so that a drinking cup received in said hole will not obstruct access to the food placed on said base by way of the front of said tray.

5. The tray for carrying food recited in claim 1, wherein said flat base, said peripheral lip and said pair of legs are all formed from molded fiber paper.

6. A tray for carrying food, said tray having a back, a front, opposite sides, and comprising a flat base on which the food is to be placed, a first raised lip projecting from and extending around the periphery of said base to form a barrier to prevent the food placed on said base from sliding off said tray, a second raised lip projecting from and extending in a direction across said base between the front and back of said tray to establish a pair of adjacent food compartments separated by said second raised lip, a hole formed through said base and dimensioned to receive a drinking cup therein, an annular rim projecting from and tapering inwardly towards said flat base and surrounding said hole to support a drinking cup received in said hole in an upright position, and a pair of legs arranged in parallel alignment with one another and depending downwardly from said base at opposite sides of said tray, said legs projecting below said base by a distance sufficient to rest upon a flat surface and to extend below the lap and along the legs of a user, each of said pair of legs having a curved inwardly facing surface to receive thereagainst the legs of the user so as to support said tray against lateral sliding displacement when the user is seated and said base is laid upon the user's lap.

7. The tray for carrying food recited in claim 1, wherein each of said pair of legs depending downwardly from and extending below said flat base has a curved inwardly facing surface to receive thereagainst the legs of the user and thereby support said tray against lateral sliding displacement.

8. The tray for carrying food recited in claim 1, wherein said annular rim surrounding said hole is tapered inwardly towards said flat base so as to support drinking cups of different diameter for receipt in said hole through said base.

* * * * *